US010088246B2

(12) United States Patent
Moreau et al.

(10) Patent No.: US 10,088,246 B2
(45) Date of Patent: Oct. 2, 2018

(54) CONNECTION DEVICE FOR HEAT EXCHANGER AND HEAT EXCHANGER PROVIDED WITH SAID CONNECTION DEVICE

(71) Applicant: Valeo Systemes Thermiques, Le Mesnil Saint Denis (FR)

(72) Inventors: Sylvain Moreau, Spay (FR); Mohamed Ibrahimi, Allones (FR); François Busson, Saint-Gervais-en-Belin (FR)

(73) Assignee: Valeo Systemes Thermiques, Le Mesnil Saint Denis (FR)

( * ) Notice: Subject to any disclaimer, the term of this patent is extended or adjusted under 35 U.S.C. 154(b) by 78 days.

(21) Appl. No.: 15/124,384

(22) PCT Filed: Mar. 4, 2015

(86) PCT No.: PCT/EP2015/054530
§ 371 (c)(1),
(2) Date: Feb. 1, 2017

(87) PCT Pub. No.: WO2015/135813
PCT Pub. Date: Sep. 17, 2015

(65) Prior Publication Data

US 2017/0153070 A1 Jun. 1, 2017

(30) Foreign Application Priority Data

Mar. 12, 2014 (FR) ..... 14 52026

(51) Int. Cl.
*F28F 9/04* (2006.01)
*F28F 9/02* (2006.01)
(Continued)

(52) U.S. Cl.
CPC ..... *F28F 9/0253* (2013.01); *F25B 39/00* (2013.01); *F28F 9/0229* (2013.01); *F25B 39/022* (2013.01); *F28F 2275/04* (2013.01)

(58) Field of Classification Search
CPC ..... F28F 9/0246; F28F 9/0253; F28F 9/0229; F28F 2275/04; F28D 1/05325; F25B 39/00; F25B 39/022
(Continued)

(56) References Cited

U.S. PATENT DOCUMENTS 4,484,622 A * 11/1984 Satchwell ..... F28F 9/0246 165/153
6,179,049 B1 * 1/2001 Higgins ..... B21D 28/28 165/140
(Continued)

FOREIGN PATENT DOCUMENTS

FR 2826437 A1 12/2002
FR 2 966 581 A1 4/2012
(Continued)

OTHER PUBLICATIONS

International Search Report issued in PCT/EP2015/054530, dated May 19, 2015 (2 pages).
(Continued)

*Primary Examiner* — Davis Hwu
(74) *Attorney, Agent, or Firm* — Osha Liang LLP

(57) ABSTRACT

A connection device for a heat exchanger between a first fluid (L) and a second fluid (G), said device comprising a connector (30) and a lateral end panel (37) of a heat exchange bundle (14) of said exchanger, said lateral panel (37) including at least one connection element (38) comprising transversely aligned inlet/outlet openings (47, 47'), said connection element (38) allowing the first fluid to flow between the bundle and the inlet and outlet openings (34, 36) of the connector (30), aligned longitudinally or at an angle relative to said inlet/outlet openings (47, 47') of the connec-
(Continued)

Figure 1:
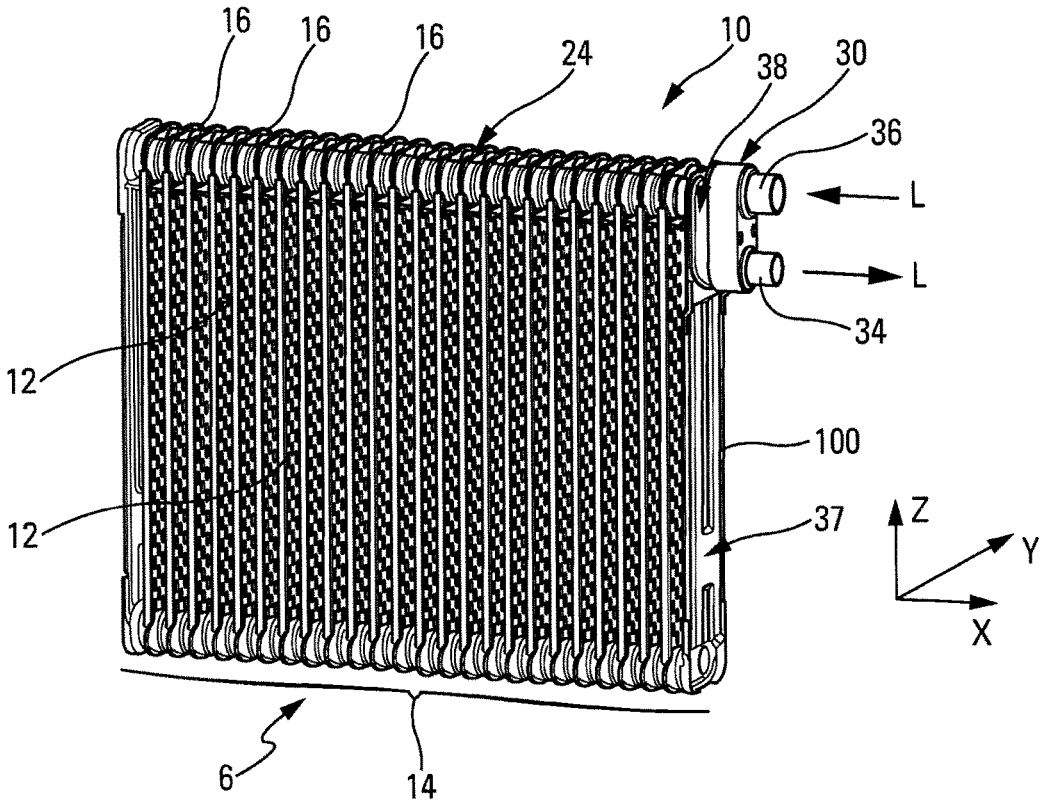

tion element (38), said connection element (38) and said connector (30) being of substantially the same length.

11 Claims, 4 Drawing Sheets

(51) Int. Cl.
*F25B 39/00* (2006.01)
*F25B 39/02* (2006.01)

(58) Field of Classification Search
USPC ..... 165/178
See application file for complete search history.

(56) References Cited

U.S. PATENT DOCUMENTS

| | | | | |
|---|---|---|---|---|
| 7,007,750 | B2 | 3/2006 | Higashiyama | |
| 2011/0108259 | A1* | 5/2011 | Groen | F28D 1/05325 165/173 |

FOREIGN PATENT DOCUMENTS

| | | | |
|---|---|---|---|
| JP | H09-61070 | A | 3/1997 |
| JP | 2000-179990 | A | 6/2000 |
| JP | 2002195784 | A | 7/2002 |

OTHER PUBLICATIONS

Written Opinion of the International Searching Authority issued in PCT/EP2015/054530, dated May 19, 2015 (6 pages).

* cited by examiner

CONNECTION DEVICE FOR HEAT EXCHANGER AND HEAT EXCHANGER PROVIDED WITH SAID CONNECTION DEVICE

The invention relates to a connection device for a heat exchanger and a heat exchanger provided with said connection device. This may in particular be an evaporator.

An evaporator, intended for an air conditioning device for the passenger compartment of a vehicle, comprising a bundle formed by a stack of plates enabling a heat exchange between an air flow passing through the bundle and a refrigerant flowing inside the bundle, is known. The bundle is arranged between two end plates, also referred to as lateral panels. This type of evaporator is described in document FR 2 826 437 filed by the applicant, and is well known to the person skilled in the art.

One of the end plates of the evaporator has two ports for the ingress of refrigerant into the evaporator and the egress of said fluid respectively.

It is also known to link the evaporator to an expansion valve by means of a connection device that is usually formed from a metal block. The expansion valve includes fluid inlet and outlet ports designed to be linked via the internal ducts of the connection device respectively to the inlet and outlet ports of the evaporator. The axes of the inlet and outlet ports of the expansion valve are parallel and lie in a plane passing substantially through a bulb of the expansion valve.

In use, the bundle of the evaporator is usually arranged vertically and the inlet and outlet ports of the evaporator therefore open out horizontally. If the internal fluid ducts of the connection device are rectilinear, the expansion valve is therefore also oriented horizontally.

However, to optimize operation of the bulb of the expansion valve, same should preferably be in a high position, which means positioning the expansion valve such that the aforementioned plane of the ports is arranged vertically or slightly inclined from the vertical. However, this poses a design problem for the connection device, in particular if a rectilinear orientation of the internal fluid ducts of same is to be maintained. It is also desirable for the solution implemented not to increase the overall size of the exchanger, or to do so only slightly, in particular in the direction of the plate stack.

The present invention is in particular intended to address the aforementioned problems and for this purpose proposes a connection device for a heat exchanger between a first fluid and a second fluid, said device comprising a connector and a lateral end panel of a heat exchange bundle of said exchanger.

According to the invention, said lateral panel has at least one connection element comprising transversely aligned inlet/outlet openings, said connection element enabling the first fluid to flow between the bundle and the inlet and outlet openings of the connector, which are aligned longitudinally or inclined in relation to said inlet/outlet openings of the connection element. Furthermore, said connection element and said connector are of substantially the same length.

In other words, according to the invention, the lateral panel of the exchanger is used to form a connection element guiding the first fluid between the bundle and the connector, thereby ensuring that the connector has the desired orientation. The orientation of the internal fluid ducts of said connector can then be rectilinear.

Furthermore, the invention exploits the fact that the environment in which the exchangers are installed enables a degree of freedom to extend the connector towards the internal fluid ducts of same. Consequently, even if the connection element of the connection device is too thick in this direction, it is only too thick in an area of no consequence since same does not extend beyond the area occupied by the connector in the longitudinal direction of the plate.

According to other features of the invention, which may be taken together or separately:

- said inlet/outlet openings of the connection element are designed to be arranged opposite the extremities of the inlet and outlet collectors of the bundle,
- the connection element has a conduit, in particular a main conduit, that is arranged coaxially with one of the inlet/outlet openings of the connector and with one of the inlet/outlet openings of the connection element,
- the connection element has a conduit, for example a second conduit, in particular an elbow conduit, that is arranged substantially within the thickness of said element and includes an extremity that is coaxial with the other inlet/outlet opening of the connector and an opposite extremity that is coaxial with the other inlet/outlet opening of the connection element,
- said lateral panel has a first plate, which has a main lower portion extending parallel to the bundle and a secondary upper portion that is positioned close to an upper extremity of said connection element and that is offset into the thickness by a given distance (d) in relation to the main lower portion,
- said lateral panel has a second plate, the thickness of which matches the given distance (d), that is seated on the secondary upper portion of the first plate,
- said first and second plates define the main conduit and the second conduit of the connection element between the secondary upper portion of the first plate and the second plate,
- said main lower portion has reinforcing ribs,
- the height of said ribs is less than the distance (d),
- the first plate is attached to the connector and the second plate is designed to be attached to the bundle,
- said first plate is also designed to be attached to the bundle,
- said main conduit and/or said second conduit are formed by stamping said first plate and/or said second plate,
- the connection element and the connector are designed to be seated in a casing that has an appropriately sized opening in which same are designed to be inserted.

The invention also relates to a heat exchanger, in particular an evaporator, including a connection device as described above.

According to different embodiments of the invention, which may be taken together or separately:

- the bundle of the exchanger and said connection device are assembled by brazing,
- the longitudinal and transverse dimensions of the first plate are substantially identical to the height and depth of the bundle.

Figure 2:
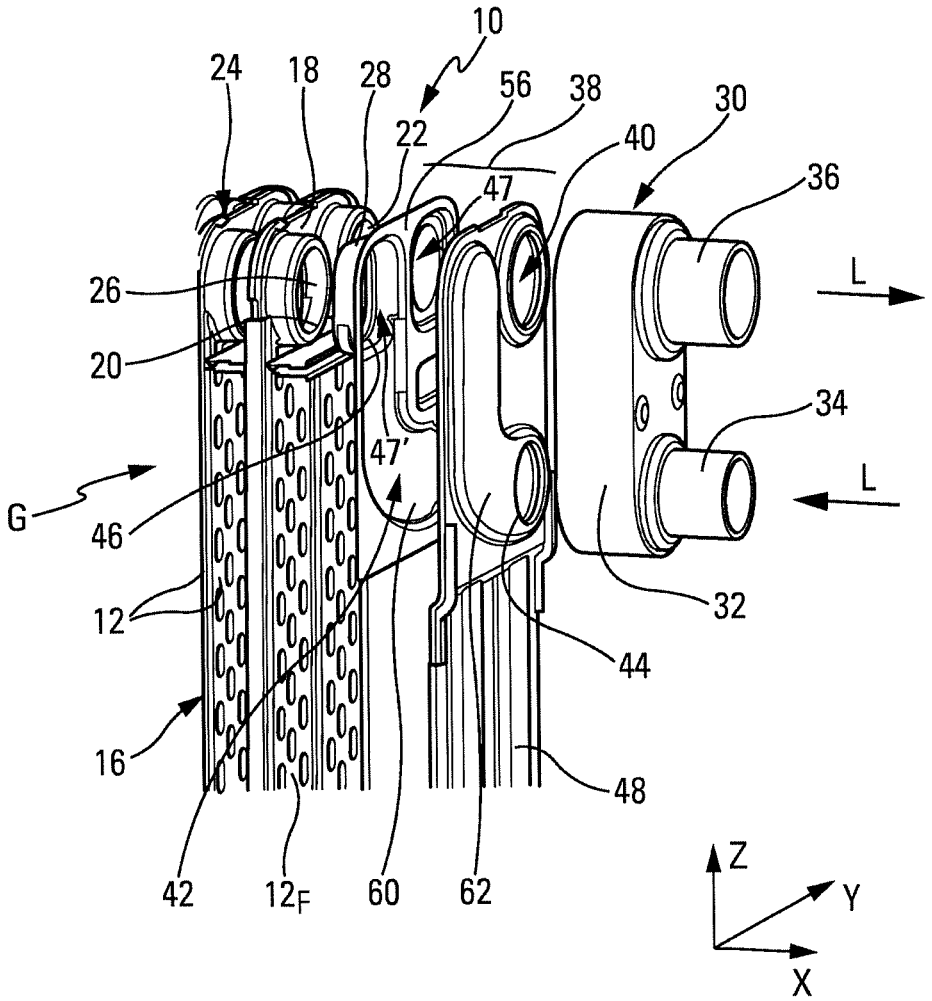
Figure 3:
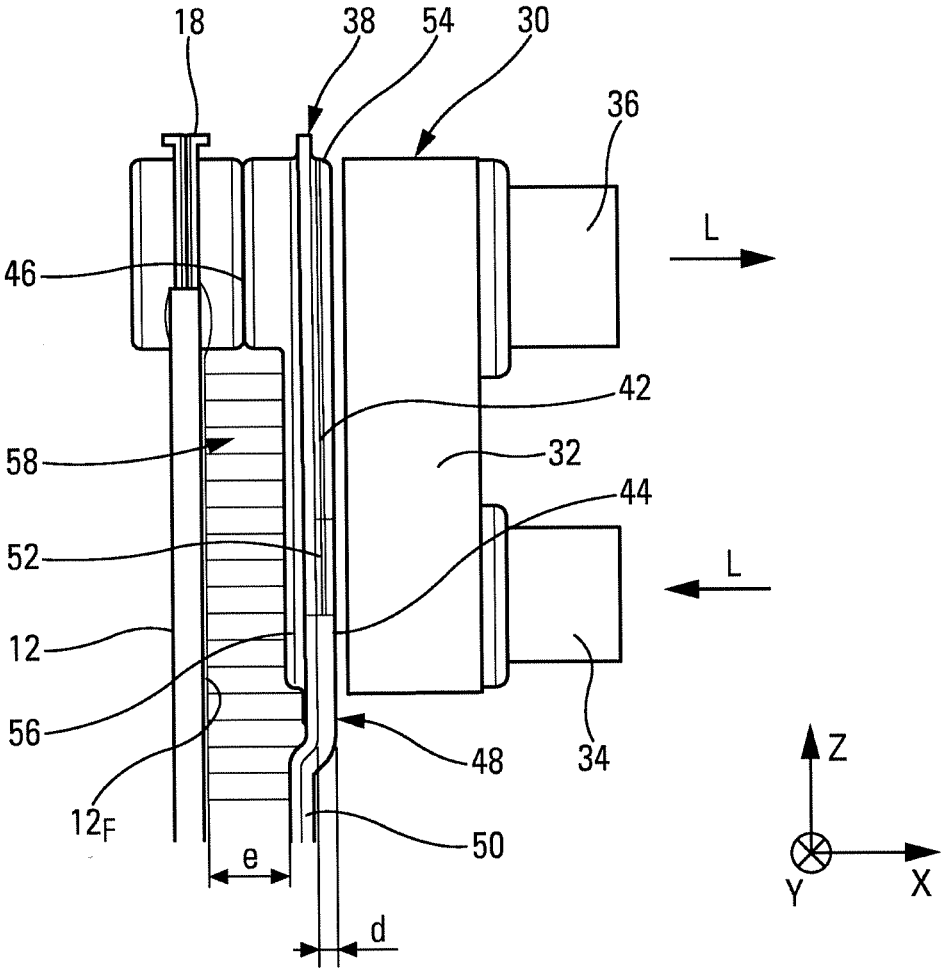
Figure 4A:
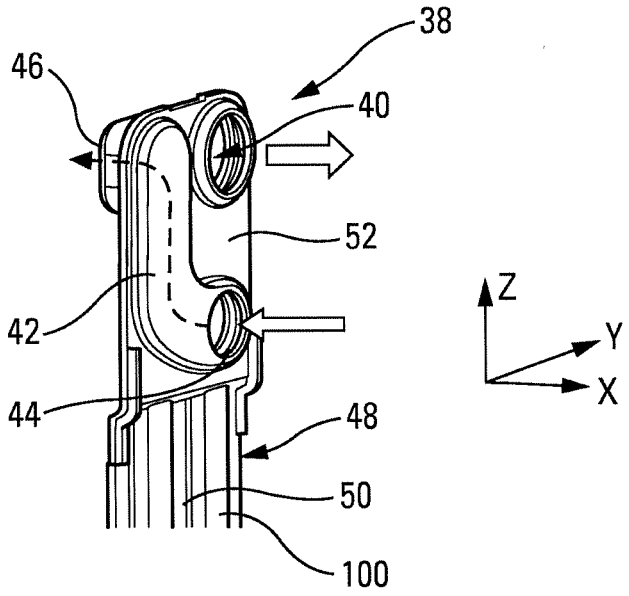
Figure 4B:
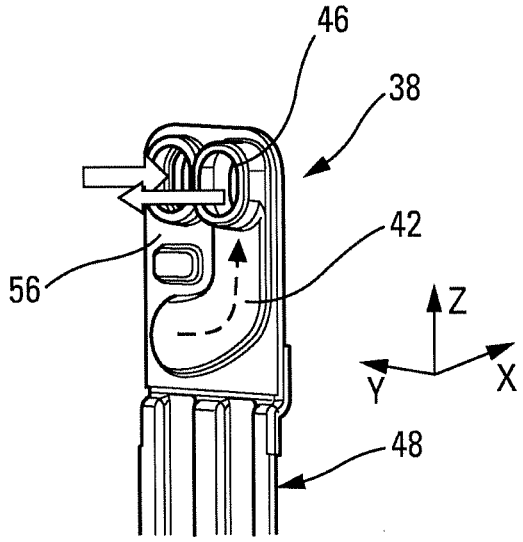

Other features and advantages of the invention are given in the detailed description below, provided with reference to the attached drawings, in which:

FIG. 1 is a perspective overview of an exchanger according to the invention, FIG. 2 is a perspective exploded detailed view of a portion of the exchanger in FIG. 1, FIG. 3 is a side view of the extremity of the exchanger in FIG. 1, FIGS. 4A and 4B are perspective views of opposing faces of the connection element of the exchanger in FIG. 1.

In the description below, identical reference signs refer to identical parts or parts having similar functions.

To facilitate comprehension of the invention, the figures are oriented with reference to the "X", "Y", "Z" axis system.

FIG. 1 shows a heat exchanger 10 according to the invention. The heat exchanger includes a bundle 14 enabling heat to be exchanged between a first fluid L and a second fluid G flowing through said bundle. In this case, said bundle 14 comprises pipes 16, arranged parallel to one another, said pipes 16 being designed to enable the first fluid L to flow inside the pipes and the second fluid G to flow between the pipes. The bundle may also include corrugated fins or inserts 58 (FIG. 3) arranged between the pipes 16 to increase the exchange surface with the second fluid G.

In the embodiment shown, the exchanger 10 has a plurality of plates 12 assembled in pairs to form the flow pipes 16 for the first fluid. Said plates 12 are in this case stacked in the stacking direction "X", and the plates 12 extend in the vertical and transverse directions "Z" and "Y".

In this case, the shape of the bundle 14 is substantially parallelepipedic.

The plates 12 form alternating circuits for the flow of the two fluids, in particular a fluid "L" in liquid and/or gaseous phase, such as a refrigerant, in particular the fluids known as R134a, 1234yf, R734a or others, which flows through the pipes or pairs 16 of plates 12, and a gas "G" such as air that flows transversely between the pipes or pairs 16 of plates, as shown by the arrows in FIGS. 1 and 2.

In this case, each plate 12 has a substantially rectangular shape and is oriented lengthwise substantially vertically in the direction "Z" and widthwise substantially transversely in the direction "Y".

As shown in FIG. 2, each plate 12 includes, at one of the vertical extremities of same referred to as the upper extremity 18, two transversely aligned openings 20, 22 that are designed to form, by stacking said plates 12, an inlet conduit or collector 26 and an outlet conduit or collector 28 for the first fluid "L" in each of the pairs 16 of plates, along one vertical end edge 24 referred to as the upper edge of said bundle.

Inside the pipe 16 formed by each pair of plates 12, the first fluid flows along a U-shaped path from one 20 of the openings in the pair of plates, acting as the inlet, towards the opposite longitudinal extremity, in this case the lower extremity, where same performs a U-turn before flowing back to the other opening 22, acting as the outlet. To do so, the plates are for example provided with an internal partition arranged longitudinally to guide the first fluid between the openings 20, 22 and the opposite extremity of the plates.

The exchanger also has a lateral end panel 37 of the bundle 14. Lateral means extending through the plane Y, Z according to the orientation shown in FIG. 1. Said panel 37 helps to protect the bundle 14, in particular the insert 58 forming the side edge of the bundle, in the stacking direction X, which is in contact with said panel 37.

The exchanger 10 also has a connector 30 comprising a body 32 and two external inlet/outlet openings 34, 36 that are designed to be connected respectively to the inlet and outlet collectors 26, 28 of the bundle 14. Said inlet/outlet openings 34, 36 are for example ducts (not shown in the figures) formed inside said body 32 and potentially leading to nozzles, as in this case. Said passages are advantageously rectilinear and/or parallel, in particular oriented in the direction X. Said connector 30 may be provided with orifices, in particular threaded orifices, enabling the attachment of piping and/or an expansion valve (not shown).

Advantageously, the connector 30 is a substantial continuation of the bundle 14, i.e. same projects neither transversely nor vertically but is contained within a projection (not shown) of the plates 12, i.e. within a continuation of the bundle 14 of plates 12 in the stacking direction X of the pipes 16 or plates 12.

According to the invention, as shown in particular in FIGS. 2, 4A and 4B, the lateral panel 37 includes a connection element 38 that is interposed between the bundle 14 and the connector 30 and that connects the transversely aligned extremities of the inlet and outlet collectors 26, 28 of the bundle, corresponding to the openings 20, 22 of the end plate 12F of same and to the inlet/outlet openings 34, 36 of the connector 30. Consequently, said connection element 38 has inlet/outlet openings 47, 47' that are in particular designed to face the inlet and outlet collectors 26, 28 of the bundle 14.

Advantageously, said inlet and outlet openings 34, 36 of the connector 30 are aligned longitudinally, i.e. in this case in the direction Z, or inclined in relation to said inlet/outlet openings 47, 47' of the connection element 38, i.e. forming a nonzero angle that is advantageously greater than 45° or 60° in relation to the direction Y. This enables the connector to be positioned with the desired orientation.

Furthermore, said connection element 38 and said connector 30 are of substantially the same length, i.e. in the direction Z. This means that the connection element 38 is substantially the same size as the connector 30 in this direction. Consequently, said lateral panel 37 only increases the size of the exchanger in the direction X in the continuation of the connector 30 in this direction.

Said connection element 38 may be wider than the connector 30, in particular as wide as the rest of the lateral panel 37.

In order to guide the first fluid in accordance with the foregoing, as shown in FIGS. 4A and 4B, the connection element 38 in this case has a main conduit 40 that is arranged coaxially with one of the inlet/outlet openings 36 of the connector and one 47 of the inlet/outlet openings of the connection element 38, for example the one facing the outlet collector 28.

The connection element 38 also has an elbow conduit 42 positioned substantially vertically within the thickness of said connection element 38. This elbow conduit 42 has an extremity 44 that is coaxial with the other inlet/outlet opening 34 of the connector 30 and an opposite extremity 46 that is coaxial with the other inlet/outlet opening 47' of the connection element 38, in this case the one facing the inlet collector 26.

As shown in FIGS. 3, 4A and 4B, the connection element 38 includes, for example, a first plate 48, that includes a main lower portion 50 arranged parallel to the end plate $\mathbf{12}_F$ and, in continuation, a secondary portion 52 positioned close to an upper extremity 54 of said connection element 38. Said upper extremity 54 of said connection element 38 is offset longitudinally in relation to the main lower portion 50 by a given distance "d".

The connection element 38 also has a second plate 56, the thickness of which matches the given distance "d", that is seated facing the secondary upper portion 52 of the first plate 48.

The main conduit 40 and the elbow conduit 42 of the element 38 are defined between the secondary upper portion 52 of the first plate 48 and the second plate 56.

In this arrangement, in which the secondary upper portion 52 of the first plate 48 is offset by the distance "d", the first plate 48 is attached to the connector 30 and the second plate 56 is attached to the end plate $\mathbf{12}_F$ of the bundle 14, at the portion of same forming the collectors 26, 28 and at a first portion of the insert 58. The main lower portion 50 of the first plate 48 is in this case attached to a second portion of the insert 58 extending said first portion of the insert 58 towards the bottom of the bundle 14.

This layout advantageously enables the second plate 56 to be sandwiched between the first plate 48 and the bundle 14, which ensures the solidity of the assembly.

The first plate 48 may be attached to the bundle 14 and the second plate 56 to the connector 30 by mechanical inversion. Although possible, this arrangement is weaker since, in this case, the second plate 56 could be stressed by the cantilevered connector 30.

As mentioned above, in this case the bundle 14 comprises plates 12, assembled in pairs 16, and inserts 58 of a given thickness "e" that are interposed between the pairs 16 of plates 12 of the bundle 14, as shown in FIG. 3.

In this arrangement, the first plate 48 is separated from the end plate $\mathbf{12}_F$ by a distance corresponding to the thickness "e" chosen to seat an end insert element 58 between the lateral panel 37 and the end plate $\mathbf{12}_F$ of the bundle 14. An insert element 58 similar to the other insert elements 58 of the bundle 14 can therefore be used.

Preferably, the first and second plates 48, 56 of the connection element 38 are formed by cutting and/or stamping sheet metal. As shown in FIG. 2, the elbow conduit 42 is thus defined by two facing L-shapes 60, 62 stamped respectively into the first and second plates 48, 56.

The lower portion of the shape 62 stamped into the first plate 48 opens out into the first plate 48 via a first cutout coinciding with the extremity 44 of the conduit 42. The upper portion of the shape 60 stamped into the second plate 56 opens out into the second plate 56 via a second cutout coinciding with the extremity 46 of the conduit 42.

Said main lower portion 50 of the first plate 48 defining the lateral panel 37 of the exchanger may include reinforcing ribs 100, in this case oriented longitudinally. The height of said ribs 100 is advantageously less than the distance (d).

The plates 12 of the bundle 14 and the connector 30 are also formed by cutting and/or stamping sheet metal and, according to this manufacturing method, the plates 12, $\mathbf{12}_F$ of the bundle 14, the plates 48, 56 of the lateral panel 37 and the body 32 of the connector 30 are assembled by brazing, advantageously in a single operation.

With reference to an exchanger 10 designed to enable heat exchanges between a refrigerant "L" and a gaseous fluid "G" as described above, the bundle 14 of plates 12, the connection element 38 and the body 32 of the connector 30 are intended to be seated in a casing (not shown) that has an opening (not shown) whose dimensions match the dimensions of the secondary upper portion 52 whereby the connector 30 protrudes. Said connection element 38 may also be inserted into said opening.

Such a casing helps to protect the entire bundle 14 and to channel the gases "G" passing through the exchanger 10.

For this purpose, the casing preferably has two opposing faces perpendicular to the direction "X" that have openings (not shown) that extend at right angles to the bundle 14 to enable the gases "G" to pass through the bundle 14 of plates.

Such an exchanger 10 may advantageously be used as an evaporator in an air conditioning circuit in a motor vehicle.

The invention claimed is:

1. A connection device for a heat exchanger between a first fluid and a second fluid, said device comprising:

a connector; and a lateral end panel of a heat exchange bundle of said exchanger, said lateral panel including at least one connection element comprising transversely aligned inlet/outlet openings, said connection element allowing the first fluid to flow between the bundle and the inlet and outlet openings of the connector, aligned longitudinally or at an angle relative to said inlet/outlet openings of the connection element, said connection element and said connector being of substantially the same length, wherein said connection element includes a main conduit that is arranged coaxially with one of the inlet/outlet openings of said connector and with one of the inlet/outlet openings of said connection element, and an elbow conduit contained substantially within a thickness of said connection element, wherein the elbow conduit has an extremity coaxial with the other inlet/outlet opening of said connector and an opposite extremity coaxial with the other inlet/outlet opening of said connection element.

2. The connection device as claimed in claim 1, wherein said lateral panel includes:

a first plate, which has a main lower portion extending parallel to the bundle and a secondary upper portion that is positioned close to an upper extremity of said connection element and that is offset into the thickness by a given distance (d) in relation to the main lower portion, and a second plate, the thickness of which matches the given distance (d), that is seated on the secondary upper portion of the first plate, to define the main conduit and the elbow conduit of the connection element between the secondary upper portion of the first plate and the second plate.

3. The connection device as claimed in claim 2, wherein said main lower portion has reinforcing ribs.

4. The connection device as claimed in claim 3, wherein the height of said ribs is less than the distance (d).

5. The connection device as claimed in claim 2, wherein the first plate is attached to the connector and the second plate is designed to be attached to the bundle.

6. The connection device as claimed in claim 5, wherein said first plate is also designed to be attached to the bundle.

7. The connection device as claimed in claim 2, wherein said main and/or elbow conduits are formed by stamping said first plate and/or said second plate.

8. The connection device as claimed in claim 1, wherein the connection element and the connector are designed to be seated in a casing that has an appropriately sized opening in which same are designed to be inserted.

9. A heat exchanger incorporating a connection device as claimed in claim 1.

10. The exchanger as claimed in claim 9, designed to operate as an evaporator.

11. The exchanger as claimed in claim 9, wherein the bundle of the exchanger and said connection device are assembled by brazing.

* * * * *